US008968050B1

(12) United States Patent
Riley

(10) Patent No.: US 8,968,050 B1
(45) **Date of Patent: *Mar. 3, 2015**

(54) BRA SAVER DEVICE

(76) Inventor: Beverly A Riley, Jonesboro, AR (US)

( * ) Notice: Subject to any disclaimer, the term of this patent is extended or adjusted under 35 U.S.C. 154(b) by 630 days.

This patent is subject to a terminal disclaimer.

(21) Appl. No.: 13/135,530

(22) Filed: Jul. 8, 2011

Related U.S. Application Data

(63) Continuation of application No. 11/706,898, filed on Feb. 13, 2007, now Pat. No. 7,976,357.

(51) Int. Cl.
*A41C 3/00* (2006.01)

(52) U.S. Cl.
USPC ..... 450/57; 2/267; 2/244

(58) Field of Classification Search
USPC ..... 450/36–38, 54–58, 1; 132/63.1, 132/107–110, 275–284; 2/267, 268, 336, 2/338, 244, 246, 46, 53–57, 455, 2/459–461, 174, 171; 63/1.15, 43; 24/592.1, 53.1, 593.11, 114, 163 FC, 24/578.1, 578.14, 903
See application file for complete search history.

(56) References Cited

U.S. PATENT DOCUMENTS

| | | | | | |
|---|---|---|---|---|---|
| 722,617 | A * | 3/1903 | Peet | 24/357 |
| 887,687 | A * | 5/1908 | McCon | 2/56 |
| 919,299 | A * | 4/1909 | Allport | 2/56 |
| 2,573,346 | A * | 10/1951 | Madsen | 2/55 |
| 2,793,644 | A * | 5/1957 | Todfield | 132/277 |
| 3,521,642 | A * | 7/1970 | Jordan | 450/55 |
| 3,568,681 | A * | 3/1971 | Comollo | 450/54 |
| 4,699,144 | A * | 10/1987 | Sherwood | 450/54 |
| 5,395,280 | A * | 3/1995 | Greenberg | 450/54 |
| 5,690,537 | A * | 11/1997 | Kalmus | 450/57 |
| 5,940,888 | A * | 8/1999 | Sher | 2/267 |
| 6,406,353 | B1 * | 6/2002 | Harper | 450/57 |

* cited by examiner

*Primary Examiner* — Gloria Hale

(57) ABSTRACT

A bra saver device made for underwire and non-underwire bras to provide protection to the wearer from sudden exposure to underwires and to provide comfort between the wearer of a bra from friction caused by movement of a bra during normal use. The present invention easily attaches to the edge of a bra by opening the clip to the present invention and placing it over the bra where ever an underwire has become exposed and then closing the clip to securely attach the present invention to a bra. The present invention can also be attached to any section of the bra at the edge along the bra at the top or the bottom, front or back where the wearer of the bra experiences discomfort.

36 Claims, 8 Drawing Sheets

BRA SAVER DEVICE

CROSS REFERENCE TO RELATED APPLICATIONS

This is a continuation of application Ser. No. 11/706,898, Filed Feb. 13, 2007, now U.S. Pat. No. 7,976,357, granted Jul. 12, 2011.

FEDERALLY SPONSORED RESEARCH not applicable

SEQUENCE LISTING OF PROGRAM not applicable

BACKGROUND OF INVENTION

1. Field of Invention

This invention relates generally to undergarment protection devices for protection from bodily harm from underwire and non-underwire bras, specifically to a cushioned structure attached to a wire, hard plastic or metal clip that prevents exposure of underwires to the skin of the user where the encasing for an underwire is torn or continuously rubs or presses against the skin of the user causing punctures or bruises to the wearer's skin. The invention also relates to the protection of the skin from any bra in the front, sides or back where friction or movement of the bra causes bruises to the wearer from constant rubbing against the body.

2. Prior Art

The undergarment industry provides consumers with an enormous selection of bras to be worn under clothing to support the breasts. The underwire bra is one of the most popular bras on the market because of its unique designs and its ability to lift up the breast in low-cut and covered blouses and other outer wear clothing.

Originally, these underwire bras were designed to provide the user with the appearance of an uplifted set of breast. However, underwire bras can be very uncomfortable after continued use and washing because the underwires protrude out from the bras over time and bruise or puncture the wearer. Even new underwire bras that have not been worn excessively tend to do the same. In some cases where the underwire does not surface, the casing for the underwire presses against the skin and rubs and bruises the skin during normal wear and movement by the user.

To address this underwire problem and the friction caused by movement in bras, inventors have created many types of underwire protection devices that cover the tips of the underwire so that if the underwire becomes exposed, it will not puncture or cause harm to the skin of the wearer. Inventors have also created devices that help restrict the movement of the bras. Lazarian's U.S. Pat. No. 6,466,268 addressed the sliding of a bra by inventing a garment support device which has a slip-resistant material impregnated into a support material, wherein selective placement of the device onto a garment decreases the friction between garment and the wearer's skin without deforming the contact surface, thus helping to prevent the garment from sliding relative to the wearer's skin. Although this device helps to keep the bra from sliding or moving excessively, it does not address the problem of protecting the wearer from the underwire exposure caused by the tearing of fabric. Other prior art inventors of U.S. Pat. Nos. 6,780,080; 4,770,650; 3,777,763; 5,830,040 and 3,605,753, invented devices that attach to the tips of the underwires to prevent damage to the user in the event of unexpected exposure; yet, these inventors did not necessarily address the bulkiness of the casing of these underwire bras that rub against the skin and cause bruises to the wearer. Other inventors of U.S. Pat. Nos. 5,730,641 and 5,749,767 changed the shapes of the ends of the underwire tips to prevent the end of the tip from becoming exposed from tearing or damage to the casing of the underwire bra. Furthermore, inventors of U.S. Pat. Nos. 6,435,939; 6,682,395 and 6,896,580 invented underwires that completely covered and protected the underwires with silicon rubber or latex (Lin), gelatinous material (Falla et al.) and gelatinous strips (Falla et al.), respectively. These inventions by Lin and Falla et al. still provide additional layers of fabric casings to cover the underwires that are bulky and that have still resulted in bruising many users due to friction. Lastly, each of these inventors did address a specific problem for the wearer but the underwire bra continues to be uncomfortable for many users even when the underwire is not exposed. Other inventors have also patented many other solutions to underwire exposure as cited in the patent applications of the aforementioned inventors and patents.

3. Objects and Advantages

Accordingly, several objects and advantages of the invention are comfort, safety, appearance and use.

It is an object of the present invention to provide the user with added protection from exposure to the underwire. An exposed underwire can puncture or bruise the skin of the user. The present invention will allow the user to reposition the underwire and place the present invention over the exposed underwire area to prevent the underwire from harming the wearer.

It is another object of the present invention to prevent an underwire from moving and eventually becoming exposed. Because the wearers of bras usually move constantly, this causes underwires to slide and twist in their casing. Eventually, the casing to the underwire tares and wears over time. By securing the present invention over the underwire casing, the encased underwire can be stabilized and prevented from movement to prolong the life of the bra.

It is still another object of the present invention to preserve and continue to wear the underwire bra in case of the unlikely event of underwire exposure. Many users of underwire bras do not experience the opportunity of repeated use of their underwire bra purchases. Many underwire bras are decorative, come as part of a set, and are expensive. In many cases, the exposure of the underwire causes the bra to not be worn or to be discarded by the wearer. The present invention allows the user to save the bra, secure the underwire, and have a longer use of the product. Having to discard a bra that is otherwise in good condition is disappointing and wasteful for the purchasers of such bras.

It is a further object of the present invention to provide comfort to the user from the continued pressure or friction near the underwire casing where underwires are inserted and encased in a bra. The cushioning structure of the present invention for underwire bras provides the wearer with enough space between the bra and the skin of the user, which prevents direct contact of the skin with exposed underwires or irritating, underwire casing. The user will only feel cushion when wearing the present invention over the underwire casing instead of the rubbing or pressing against the skin that usually occurs during use. The present invention, when used properly, is stable until removed and can minimize the sliding and movement of the bra during use. The present invention will also provide protection from non-underwire bras that cause bruising from rubbing or friction.

It is still another object of the present invention to provide a stable clip that attaches to the underwire bra over the underwire casing or other bra structures that rub and cause friction between the bra and the wearer.

It is still a further object of the present invention to attach to a bra securely and to be easy to use.

The clip of present invention opens and closes with ease.

It is a further object of the present invention to provide an attractive device that allows wearers of underwire and non-underwire bras to protect their skin and their bras with a product that is decorative, appealing, reusable, exchangeable and even scented. The present invention will provide the user with a large selection of colors, sizes, styles, and degrees of comfort and smell. The present invention will be available in an enormous variety of colors or designs that will appeal to its users by providing the consumer with a choice of selecting an already secured clip cover or an exchangeable slip-on clip cover. The exchangeable slip-on covers that cover the visible portion of the clip of the present invention will be made to appeal to almost any consumer preference because the slip-on covers can be selected to match any color choice due to the present invention's slip-on cover materials. The consumer will be able to choose a cover from fabric, gelatinous materials, or soft plastic materials. The gelatinous material slip-on covers, which because of the unique qualities of gelatinous material, will provide consumers with design choices, scent choices, and multi-color choices that may not be available with a fabric cover choice. Further, the gelatinous material slip-on covers can be easily taken on and off the clip with ease and remain in place due to its unique qualities. The surface of gelatinous material also provides consumers or manufacturers with the ability to attach decorative decals to the covers, unlike fabric with usually require more effort to apply than an extremely small stick-on decal. An enormous, decal selection of small and decorative styles is available on the market today which will provide unlimited decorative abilities for the users or manufacturers of the present invention. Gelatinous material can be scented easily during the manufacturing process as well. Additionally, the slip-on covers of the present inventions will also be available in plastic materials. Likewise, plastic has unique qualities as well. The plastic slip-on covers will provide similar variety choices as with the gelatinous material slip-on covers, but can be made of more different degrees of feel or touch due its soft or hard qualities. Finally, fabric slip-on covers will be available with the present invention. Fabric slip-on covers will also provide consumers with many design choices in color, design, appearance and feel. Fabric has unique qualities that will provide decorative choices unavailable with gelatinous or plastic materials, such as ribbon, lace, flexibility of fabric. Likewise, embroidered or flat foam slip-on covers can be manufactured with attached pockets or pouches to allow slip on covers to be easily attached to the front portion of the clip and changed as desired. These pockets or pouches are be made of slip resistant materials such as thin plastic, rubber, fabric that will insure that these slip-on covers remain in place until removed. To conclude, the appearance and selections available to the users of the present invention will insure that it will appeal to the masses in shape, color, design, comfort and in smells. A unique advantage of the slip-on covers is the ability of the consumers to change the scents or designs of the front portion of the present invention.

It is still a further object of the present invention to be just as attractive as it is comfortable with a variety of shapes, color, and degrees of comfort or feel. The cushioning structure of the present invention provides a cushion or padded protection to the user because its components. The cushioning structure of the present invention consists of materials that provide different degrees of comfort depending on the selection. The key materials used to provide a cushioning structure for the present invention are be made of foam, gelatinous materials, fabric or a combination of these. The foam material of the cushioning structure has the effect of a pillow by providing a medium between the users skin and any area on the users bra that may be harmed due to sudden exposure of an under-wire in a underwire bra and its casing or structures as well as non-underwire bras and their structures that cause friction from movement or its casing or structures that bruise or harm the users exposed skin. Foam has unique qualities in that foam can provide for degrees of comfort or feel, shaping capabilities, and appearance choices. The foam used in the present invention that will be attached to the bottom portion of the clip and that will have contact with the user of the present invention can be shaped to appeal to consumer preference. Shapes can be formed with foam easily due to its composition. Furthermore, foam can be multicolored, made to resemble many shapes or formed to resemble many different types of items or things. The foam material of the present invention can be shaped to form geometric, animal, insect, fruit, food, novelty items or characters, letters, flowers, and other types of items such as a heart, star, moon, zodiac sign, and have the appearance of a picture of something. Foam has been used in the marketplace to resemble a plethora of things that look identical to those items due to its coloring and shaping capabilities. Additionally, foam can be enclosed in fabric and is flexible enough to be sewn through to form shapes with ease. Furthermore, foam can be coated to provide different types of feel or protective coatings and it can also be scented. To conclude, the present invention will provide consumers with all these foam choices along with a comfortable cushioning structure to protect their skin or bra from harm.

These and other objects and advantages of the present invention are achieved by the front portion of the clip which is covered with either fabric, an embroidered design, lace or ribbon and/or fabric stick-on or sew-on decals; or alternatively, the clip can be covered with gelatinous material, plastic materials or flattened foam material shapes that are soft to the skin and not irritating or scratchy on the outer surface. These fabric, lace, ribbon or decals are commonly used to make undergarments for lingerie garments. Gelatinous materials and soft plastics are widely used within the bra industry around on or attached to the underwires in underwire bras to provide protection in the event of sudden underwire exposure. The front portion of the clip of the invention looks sleek, dainty and is very small in appearance. This makes it almost unnoticeable once in place. The wire clip, once secured in place, lies in a curved position and becomes seemingly one with the bra and it does not protrude or show through clothing. The fabric, lace or ribbon with or without decal covering or the gelatinous material or plastic covering of the wire clip of the present invention also prevents the clip from damaging the outer clothing. The fabric covering of the clip of the present invention can be manufactured using numerous colors and will be widely available in the basic bra colors such as white, black or beige. The gelatinous material or plastic covering of the top, outside portion of the clip or the bottom, base portion of the clip can be manufactured to cover the entire clip or just the base of the clip. The gelatinous material or plastic covering for the top side of the clip can be manufactured in practically any color and due to the characteristics of plastic and gelatinous materials; the covers can be scented or unscented. Additionally, the covering for the top portion of the clip can be removable to allow users to change the style, smell, color or design of the cover to compliment any bra. Thus, the present invention also will provide consumers with a variety of options to utilize the present invention.

In the second embodiment of the present invention which is the back side of the present invention, there is provided up to six (6) layers of materials and the base of the attaching mechanism (clip). These layers insure that the base will not become exposed and that added cushion will be provided to the user, herein referred to as a cushioning structure. The first two layers are either gelatinous material, VELCRO® (hook and loop faster) material, fabric or a soft plastic material sandwiching the base of the clip. This gelatinous material or soft plastic will be applied to the clip during manufacture or manufactured and provided with a stick on capability for use on the present invention. This manufacturing process of securing the gelatinous material to the clip will insure that no portion of the base of the clip will become exposed, because the process will completely enclose the clip on all sides, front and back expect for the opening section of the clip. Likewise, in cases where the gelatinous material or plastic is applied using a stick on capability, the gelatinous or plastic material enclosing the bottom portion of the clip base will enclose all sides, front and back except for the opening section of the clip, as shown in FIG. 21. The third and fourth layers comprise two identically shaped pieces of foam that is applied to the gelatinous or plastic material layers sandwiching the base of the clip by adhesion or using adhesive strips. These adhesive component or layer used to attach the shaped pieces of foam to the bottom portion of the base of the clip can be applied to the base of the foam by strip, by application or applied to the foam shaped pieces during manufacture. The foam shaped pieces, wherein the adhesive is applied during manufacture, will still require the removal of paper or a similar product, commonly used with stick on products, to protect the adhesive prior to application. However, the adhesive strip or layer will provide enormous possibilities for the substitution of foam shapes for the consumer if desirable or in cases where the foam wears from repeated use. A fifth layer of the present invention provides for a protective outer layer to certain foam shapes. This fifth layer will be optional, but can provide additional comfort to the user. This fifth layer will be applied to the foam during the manufacturing process when available. This fifth layer will make the appearance of the foam feel smoother and look more polished, which is frequently used on foam in padded bras or bra inserts. The fifth layer is optional because certain foam designs will loose their appearance features with the fifth layer, which will only be available in mostly solid colors. All these layers insure that the base of the clip will not be exposed; the clip will not damage the bra; the cushioning structure will be comfortable to the user and the cushioning structure will provide padding for the front portion of the clip to protect the users bra during use and application. These layers are strong but not bulky and cannot be seen when the present invention is in place; however, their decorative appeal will help insure market acceptance, even though the foam or fabric design will only be seen by the consumer user during application or purchase. The use of the present invention and its acceptance in the marketplace will insure that fewer users of underwire and non-underwire bras and their structures will not continue to harm consumers and will prolong the life of such bras.

Furthermore, the outer layer encasing the bottom portion of the base of the clip can be manufactured to match the color of the front outer portion clip and will be available in basic and numerous colors, designs or shapes for the wearer to purchase. Various types of shapes for the front portion of the clip can also be utilized. The current invention provides for a shape that will fit perfectly over the top portion of the clip and is in the same shape as the top portion of the clip. Also, a fabric, plastic, paper, flattened foam, or foam type press-on or stick-on decal, that does not protrude and that will move with the clip, such as a flower, leaf, animal or fruit or any other thin foam shape or embroidered design will also be available to consumers of the present invention and these covers can match the shaped foamed pieces that attach to the bottom portion of the clip. This capability has been provided for and is illustrated in FIGS. 38, 40, and 41. Additionally, the alternative gelatinous or plastic covering of the front portion of the clip will provide an enormous selection of colors, designs, texture and appearance. Also the stick-on decals can be placed on the covers of the clip to add extra appeal for consumers when using a fabric, plastic, flattened foam or gelatinous material cover for the top-portion of the clip.

Another advantage of the present invention is that it is extremely small, easy to manufacture and lightweight. Its cost to produce will be low and the price to the consumer will be inexpensive, considering the benefits obtained from its usage.

An added advantage of the present invention is the option to purchase the present invention with the foam shapes attached, that cannot be removed, or to purchase the product with attachable and removable foam shapes and clip covers for the bottom portion of the clip as well as the top portion of the clip.

A final advantage and important aspect of the present invention is that it is disposable and its cost will be extremely low compared to an all fabric based similar product. The present invention is also washable and reusable. It will be easy to clean and maintain by the user or it can be disposed.

The present invention is novel in that no previous inventors have addressed the underwire discomfort or safety from this perspective. Other inventors have created cushioning structures to address the safety of underwire bras by covering the underwire with materials, enclosing the underwire in layers of materials or changing the shape of the underwire. Some inventors have added materials or additional cushioning materials to the tips of the underwires to protect the user. The present invention supports the fact that the use, washing, and continual movement in bras will not provide protection from underwire and other bras from sudden or unexpected harm. The present invention acknowledges that underwires will continue to become exposed or the covering or casing of underwires in bras will continue to cause friction between the bra and the wearer's skin. The present invention approaches the underwire exposure from the outside of the bra instead of from the inside by providing the user with additional protection that attaches from the outside exactly where the problem may occur in a discrete and inexpensive way.

SUMMARY OF THE INVENTION

In accordance with the present invention, the bra saver device comprises a clip enclosed in cushioned foam, fabric, gelatinous or plastic materials with a decorative outer appearance and is reusable, exchangeable or disposable for a low price that attaches to a bra for protection from underwires in bras and/or friction that causes bruises from underwire bra casings or non-underwire bras. It is small, inexpensive to make, available in many colors, shapes and designs and will not harm the user or the bra. The present invention is easy to use and maintain for the consumer.

SUMMARY

In accordance with the present invention a bra saver device comprising a cushioning structure sandwiching a wire, metal or hard plastic clip that attaches to a bra made of multiple layers comprising a selection of fabric, foam, adhesive, gelatinous or plastic material, lace, ribbon or stick on decals or various combinations thereof.

DRAWINGS—FIGURES

FIG. 13 also show that the adhesive strip or adhesive substance has been attached to the foam piece prior to attaching to the gelatinous material that has is enclosing the bottom portion of the clip base.

Figure 15:
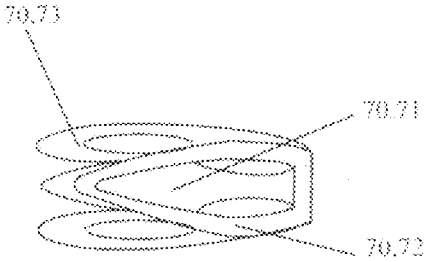
FIG. 15 is a perspective front-side view of the clip used as a component part of the present invention, wherein the base of the clip has prongs.
Figure 16:
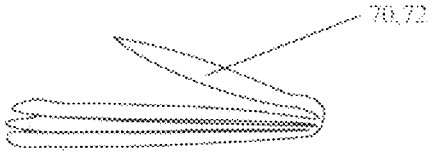
FIG. 16 is a perspective right-side view of the said clip in FIG. 15.
Figure 17:
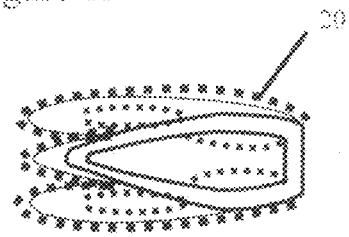
FIG. 17 is a perspective front view of the clip of FIG. 15 and FIG. 16 after the bottom portion of the clip has been covered in gelatinous material or a plastic coating.
Figure 20:
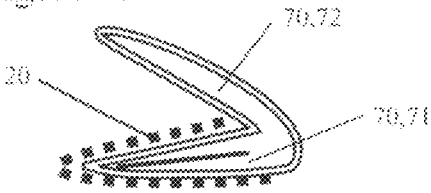
FIG. 20 is a perspective right-side view of the clip as shown FIG. 15 and FIG. 16 with a gelatinous material or plastic coating sandwiching the bottom portion of said clip.
Figure 21:
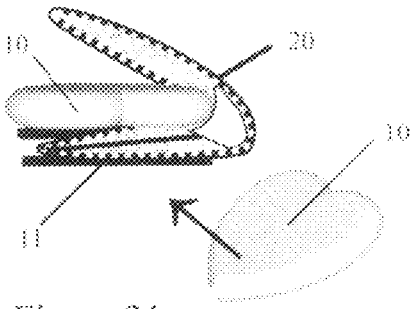

FIG. 21 is a perspective right-side view of the clip as shown in FIG. 15 and FIG. 16 showing the placement of the shaped foam pieces and adhesive prior to sandwiching the clip as shown in FIG. 20. FIG. 21 also shows a front-side view of the foam shape that will be attached for illustrative purposes. FIG. 21 also shows that an adhesive strip or adhesive substance has been applied to the gelatinous material of the bottom portion of the clip base before attaching the foam piece.

Figure 18:
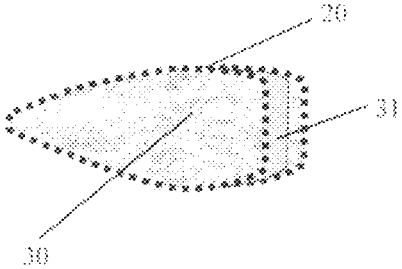
FIG. 18 is a perspective front view of a gelatinous material or plastic, slip-on cover that is used to cover the top portion of the clip of FIG. 17, when said top portion clip is not already covered as shown in for the clip of FIG. 9.
Figure 22:
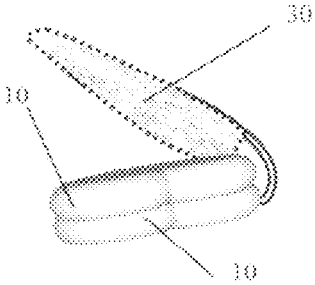

FIG. 22 is a perspective right-side of the view of FIG. 21 after the shaped foam pieces are attached or applied to the clip of FIG. 20 with the gelatinous material or plastic slip-on cover of FIG. 18 is placed over the top-portion of the clip of FIG. 20 or FIG. 21.

Figure 23:
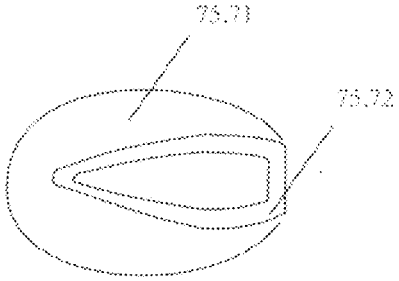

FIG. 23 is a perspective front-side view of the clip used as a component part of the present invention, wherein the base of the clip is shaped to resemble the shaped foam pieces to be attached to the base of the clip to form a cushioning structure or the base of the clip is sufficient enough to the size of the foam shapes to be attached or applied to the base of the clip.

Figure 24:
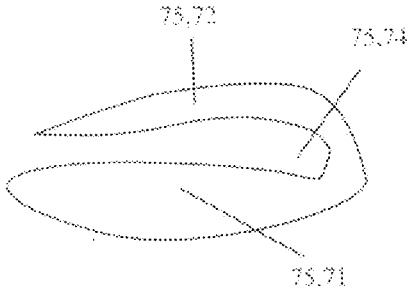

FIG. 24 is a perspective right-side view of the said clip in FIG. 23.

Figure 25:
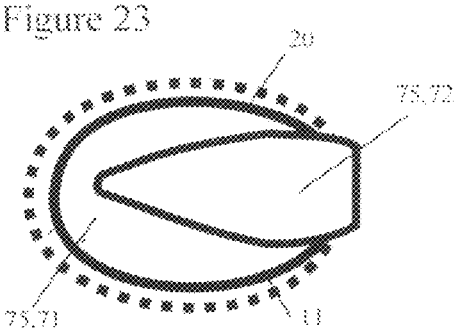

FIG. 25 is a perspective front view of the clip of FIG. 23 and FIG. 24 after the bottom portion of the clip has been covered in gelatinous material or a plastic coating.

Figure 9:
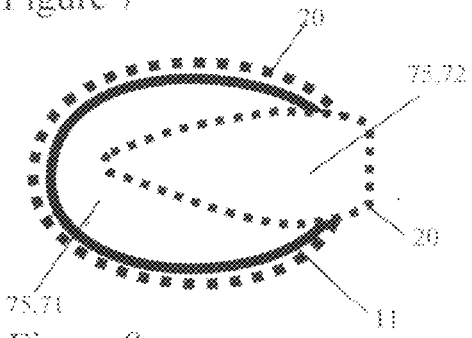
FIG. 9 is a perspective front view of the clip of FIG. 7 and FIG. 8 after the entire clip has been covered in gelatinous material or a plastic coating.
Figure 10:
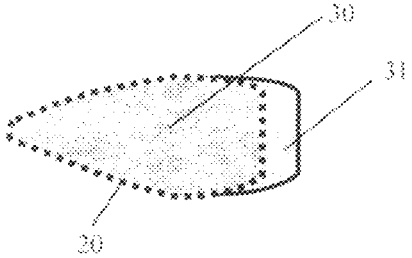
FIG. 10 is a perspective front view of a gelatinous material or plastic, slip-on cover that is used to cover the top portion of the clip of FIG. 8, when said top portion clip is not already covered as shown in FIG. 9.
Figure 26:
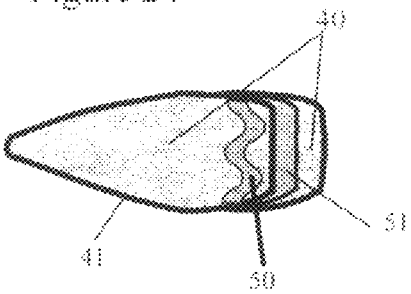

FIG. 26 is a perspective front view of a fabric slip-on cover that is used to cover the top portion of the clip of FIG. 23, when said top portion clip is not already covered as shown for the clip of FIG. 9.

Figure 2:
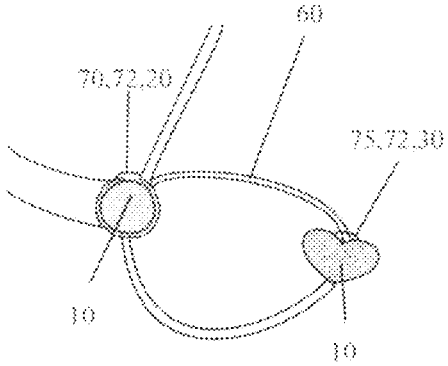
FIG. 2 is a perspective back view of the present invention and its intended use with a bra.
Figure 27:
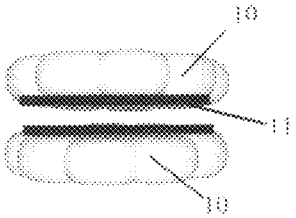

FIG. 27 is a perspective side view of the two foam shapes shown in FIG. 2 with adhesive strips or material after adhesive is attached or applied to foam shapes.

Figure 28:
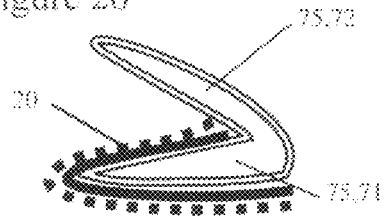

FIG. 28 is a perspective right-side view of the clip as shown FIG. 23 and FIG. 24 with a gelatinous material or plastic coating sandwiching the bottom portion of said clip.

Figure 29:
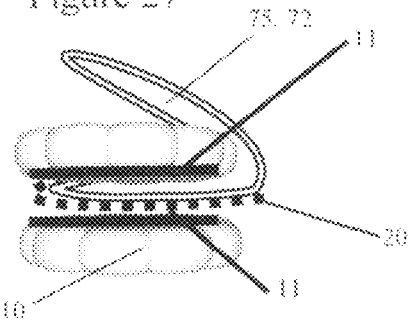

FIG. 29 is a perspective right-side view of the clip as shown in FIG. 23 and FIG. 24 showing the placement of the shaped foam pieces and adhesive prior to sandwiching the clip as shown in FIG. 28.

Figure 30:
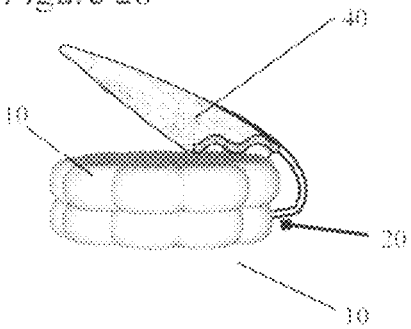

FIG. 30 is a perspective right-side of the view of FIG. 29 after the shaped foam pieces are attached or applied to the clip of FIG. 29 with the fabric slip-on cover of FIG. 26 placed over the top-portion of the clip of FIG. 28 or 25.

Figure 31:
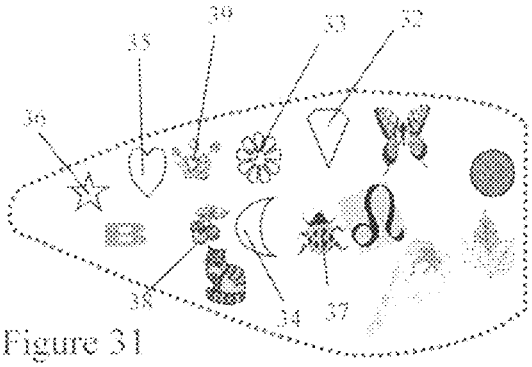

FIG. 31 is a perspective front or back side view of a gelatinous or plastic material slip-on cover as shown in FIG. 1, 2, 10, 18, 22, or 30, with decorative stick-on decals.

Figure 32:
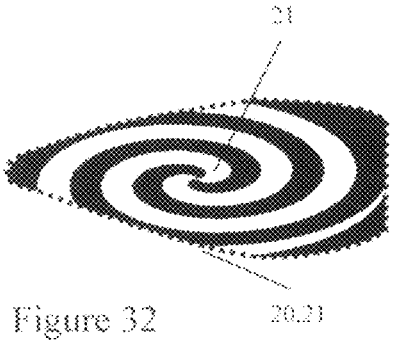

FIG. 32 is a perspective front or back side view of a gelatinous or plastic material slip-on cover as shown in FIG. 1, 2, 10, 18, 22, or 30, wherein the slip-on cover has a design embedded within the gelatinous or plastic material cover.

Figure 33:
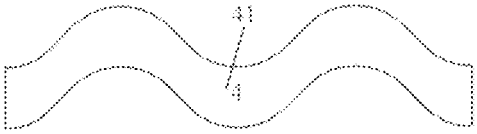

FIG. 33 is a flat view of a piece of fabric as shown in FIGS. 1, 2, 26 and 30.

Figure 34:
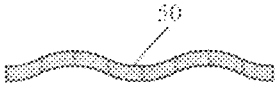

FIG. 34 is a flat view of a piece of lace or ribbon as shown in FIGS. 26 and 30.

Figure 35:
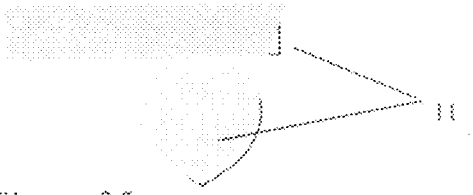

FIG. 35 is a flat view of an adhesive strip as shown in FIGS. 11, 13, 19, 21, 27, and 29.

Figure 36:
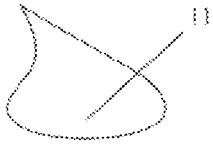

FIG. 36 is a flat view of a drop of adhesive as shown in FIGS. 11,13,19,21,27, and 29 which may be substituted for an adhesive strip or applied during manufacture of foam shapes.

Figure 37:
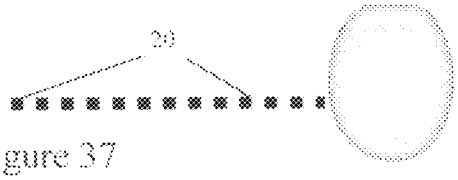

FIG. 37 is a dotted line that represents the application of gelatinous material or plastic applied to clip to cover top or bottom portion of clip or to make slip-on clip covers as shown in FIGS. 3, 4, 6, 9, 10, 12, 13, 17, 18, 20, 21, 25, 28, 29, 31 and 32.

Figure 38:
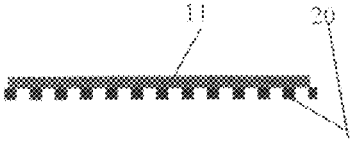

FIG. 38 an illustration of shaped piece gelatinous material with and adhesive strip attached that must be removed before application to the base of the bottom portion of the clip.

Figure 39:
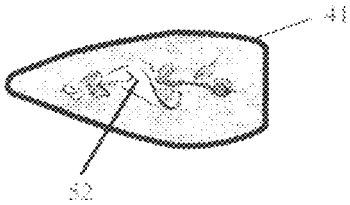

FIG. 39 is the top portion of a fabric cover for the top portion of the clip with a sew-on or stick-on floral decal.

Figure 40:
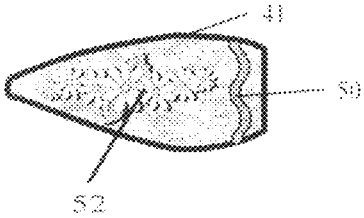

FIG. 40 is the top portion of a fabric cover for the top portion of the clip with a sew-on or stick-on floral decal and a lace border.

Figure 41:
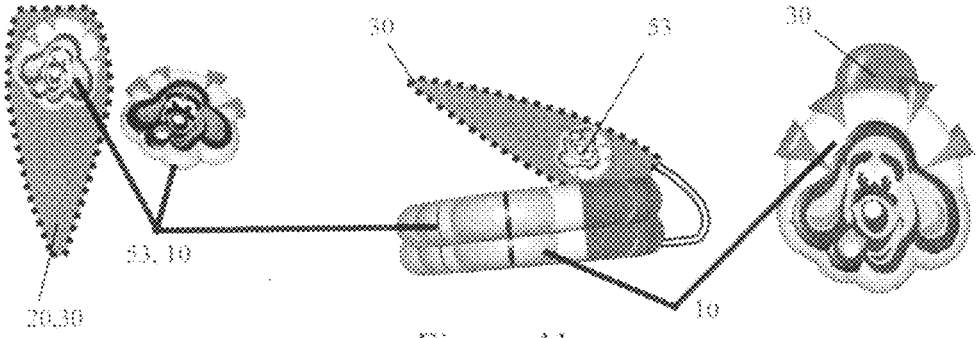

FIG. 41 is an illustration of the present invention with a matching foam cushioning structure with a gelatinous or plastic slip-on cover with a matching flat foam decal shown for a puppy dog.

Figure 42:
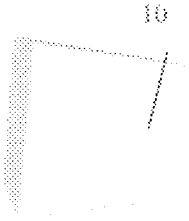

FIG. 42 is a piece of shaped foam made to resemble a square or rectangle.

Figure 43:
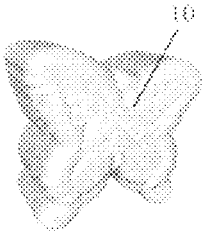

FIG. 43 is a piece of shaped foam made to resemble a butterfly or insect with a protective coating.

Figure 44:
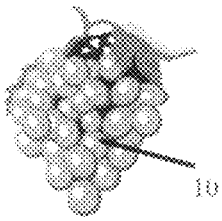

FIG. 44 is a piece of shaped foam made to resemble a grape cluster or a fruit.

Figure 45:
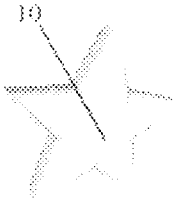

FIG. 45 is a piece of shaped foam made to resemble a star.

Figure 46:
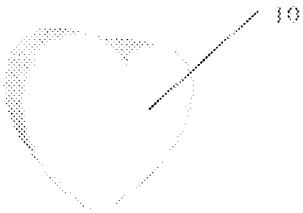

FIG. 46 is a piece of shaped foam made to resemble a heart

Figure 47:
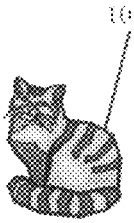

FIG. 47 is a piece of shaped foam made to resemble a cat or an animal.

Figure 48:
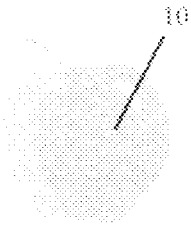

FIG. 48 is a piece of shaped foam made to resemble an apple or fruit.

Figure 49:
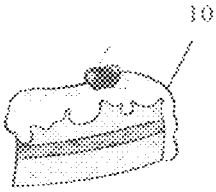

FIG. 49 is a piece of shaped foam made to resemble an a slice of cake

Figure 50:
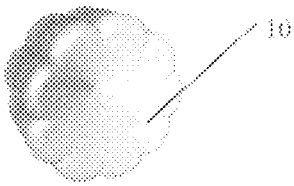

FIG. 50 is a piece of shaped foam made to resemble a flower with a protective coating.

Figure 51:
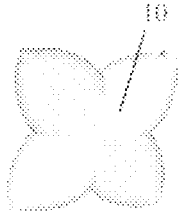

FIG. 51 is a piece of shaped foam made to resemble a flower.

Figure 52:
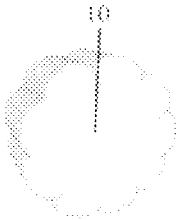

FIG. 52 is a piece of shaped foam made to resemble a flower.

Figure 53:
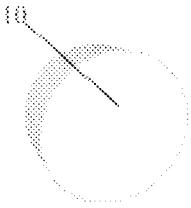

FIG. 53 is a piece of shaped foam made to resemble a circle.

Figure 85:
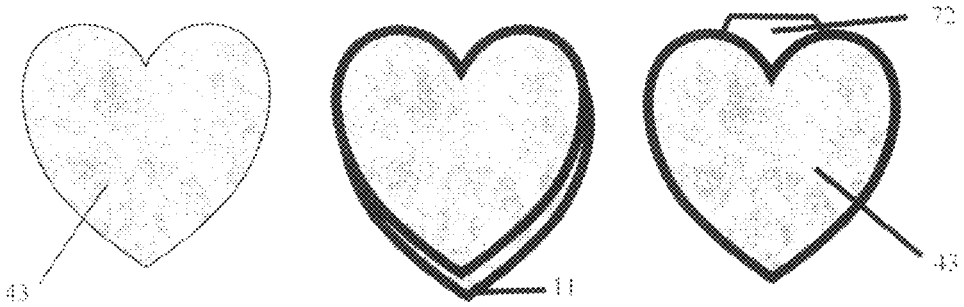
Figure 90:
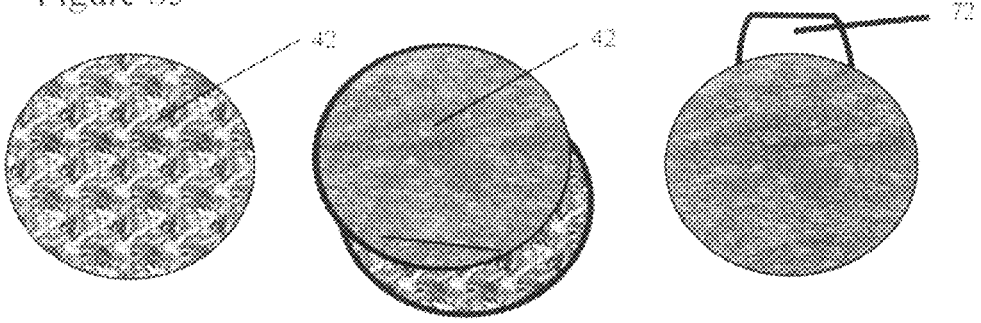
Figure 95:
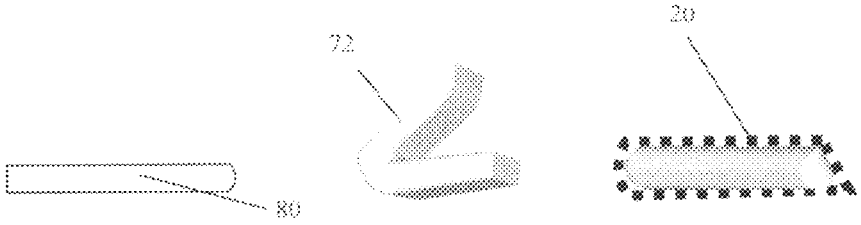

FIG. 85 shows a fabric and fabric layers after being attached to the base portion of a clip prong in the shape of a heart FIG. 90 shows a layer of VELCRO (hook and loop fastener) and its attachment and its application to the base portion of a clip prong in the shape of a circle FIG. 95 shows a clip with the top and base portions made of a piece of bendable metal in the shape of a rectangle, uncovered and than covered with its first layer surrounding the entire clip.

Figure 96:
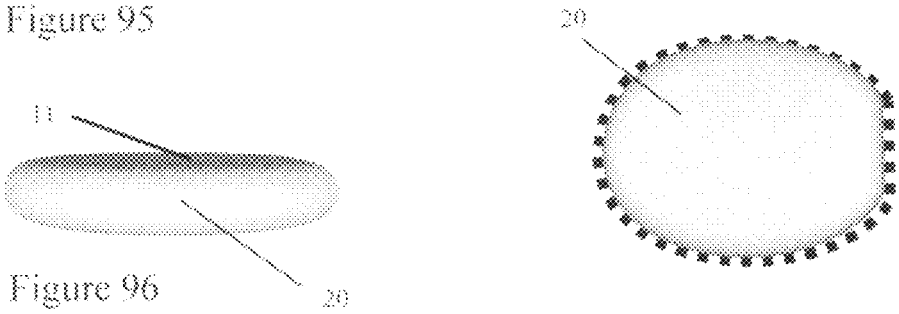
Figure 10O:
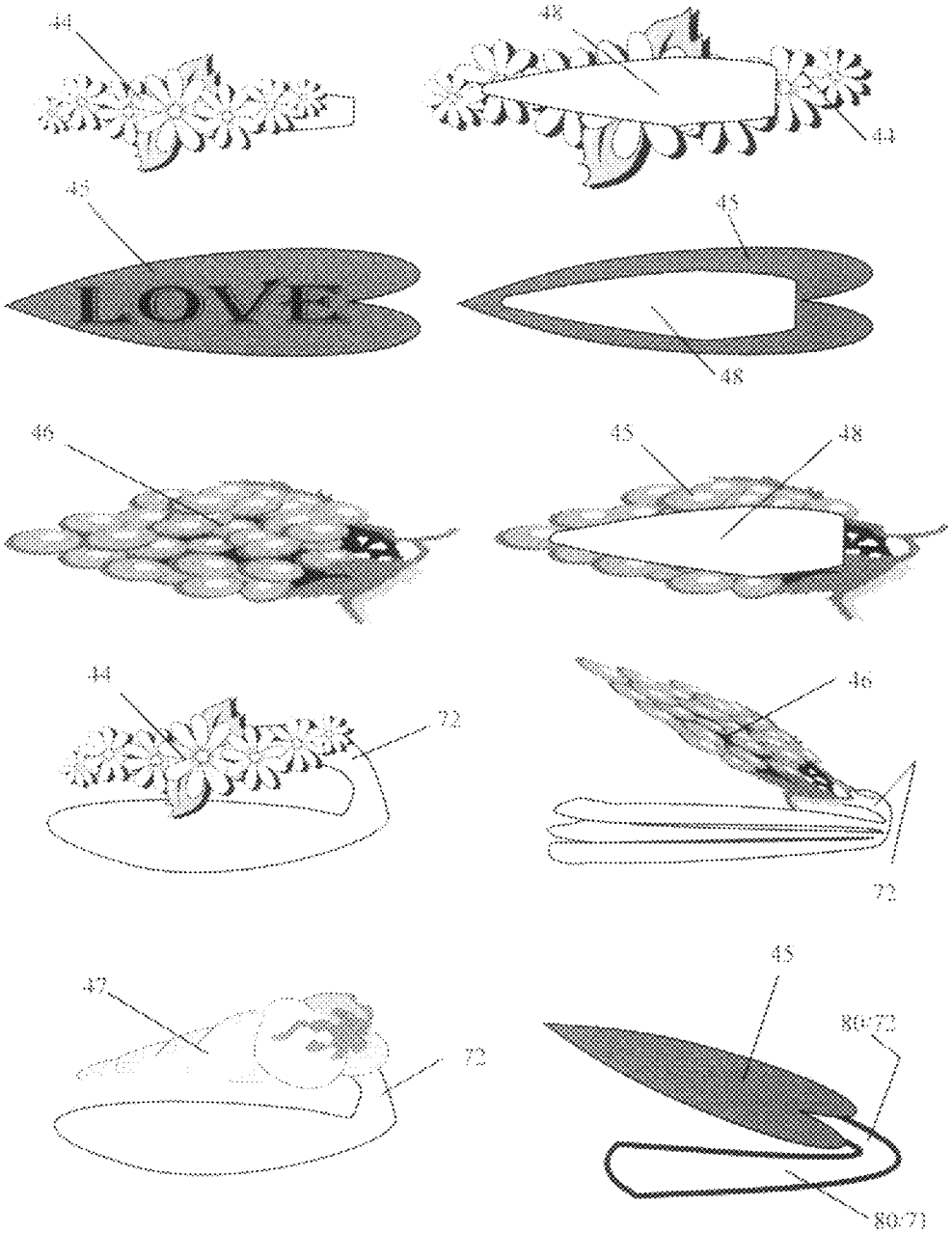

FIG. 96 shows a piece of gelatinous material that is used to cover the base portion of a clip prong with an adhesive layer attached to the side that will sandwich bottom portion of the clip base prong/s.

FIG. 100 shows a selection of elongated embroidered or flat foam slip-on covers attached to the top portion of the clip prong with a lettered, flattened foam shape, an elongated grape cluster, an elongated ice cream cone, and an elongated floral arrangement with the back side showing the pouch or pocket attached thereon.

REFERENCE MATERIALS

10 Shaped Foam with or without a protective film coating
11 Adhesive coating or strip
20 Gelatinous or plastic material covering
21 Decorative gelatinous material or plastic covering
30 Gelatinous material or plastic slip-on cover
31 Gelatinous material or plastic slip-on cover opening
32 Decorative stick on decal—a jewel type decal
33 Decorative stick on decal—a floral type decal
34 Decorative stick on decal—a moon type decal
35 Decorative stick on decal—a heart type decal
36 Decorative stick on decal—a star type decal
37 Decorative stick on decal—a ladybug type decal
38 Decorative stick on decal—a fruit (cherry) type decal
39 Decorative stick on decal—a floral bouquet type decal
40 Fabric material slip-on cover
41 Fabric that covers top portion of clip
42 Velcro (hook and loop fastener) cut into the form of a circle
43 Fabric
44 Embroidered or flattened foam elongated decal in a floral design
45 Flattened foam elongated decal with lettering
46 Embroidered or flattened foam elongated decal in a grape cluster/fruit design
47 Embroidered or flattened foam elongated decal in a ice cream cone/food design
48 adhesive backed, slip-on pouch made of rubber, thin plastic, or fabric
50 Lace or ribbon that covers the fabric that covers front portion of clip
51 Opening of fabric slip-on cover
52 Decorative embroidered fabric stick on or sew on decal—floral
53 Decorative foam stick-on or plastic stick on decal—a puppy dog
54 Decorative foam stick-on or plastic stick on decal—a grape cluster
60 Bra for illustration
70 Wire clip with prongs (manufactured component part)
71 Bottom side of wire clip (also referred to as "clip", clip base or bottom portion of clip)
72 Top side of wire clip (also referred to as "clip" or front/top portion of clip)
73 Wire, metal or plastic clip prongs
74 Opening of the clip that surrounds the bra casing or the edge of a bra
75 Wire, metal or plastic clip with shaped base
80 Bendable metal clip the shape of a rectangle

DETAILED DESCRIPTION OF THE INVENTION—PREFERRED EMBODIMENTS

Figure 3:
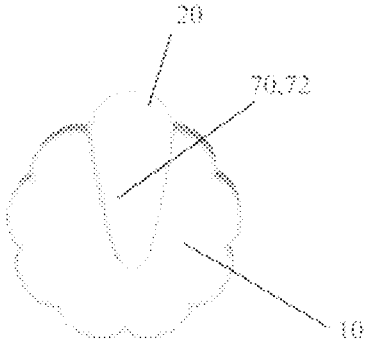
FIG. 3 is a perspective front-side view showing the present invention and its outer front layers.

FIG. 3 is a perspective view from the front-side of the bra saver device in accordance with the present invention. The invention is made up of a multi-pronged clip (70 or 75) or a bendable metal clip (80) sandwiched between gelatinous, flattened foam, soft plastic, VELCO (hook and loop fastener) or fabric material (20) and covered with two identical pieces of shaped foam (10), applied individually using adhesive coating or an adhesive strip (11) to the bottom portion or base of the clip prong/s at the top and the bottom of the bottom portion of the clip (70 or 75). Additionally, the foam can be covered with another optional layer of fabric. The gelatinous material, flattened foam material or soft plastic material can be scented or unscented. Alternatively, the foam shape covering the base of the clip that covers the material layer covering the uncovered base of the bottom portion clip prong/s can have an optional, protective coating; and the foam layers can be scented or unscented. The top portion of the invention is made up of a slip-on cover made of a choice of fabric, lace or ribbon, with or without, decals placed about a portion of the slip on cover, or a combination thereof, (40) or a slip-on cover made of a gelatinous, flattened foam, or plastic material slip-on cover, with or without, a decal/s placed about a portion of the material (30) attached to the top portion of the clip. Alternatively, the cover for the top portion of the clip prong and can be made of a choice of gelatinous, flattened foam, plastic or fabric material, with or without, decal/s placed about a portion of the cover that is not detachable. Alternatively, the slip-on cover can be replaced with an elongated embroidered design or flattened foam cover resembling a floral, lettered, shaped, or other design with an attached pouch on its back side that is slip resistant so that the elongated cover can slide onto the top portion of the clip prong of the present invention. The invention can also have optional stick-on or sew-on decal/s on the slip-on covers or permanent covers (30). Furthermore, the top portion of the clip covers and the cushioning structure attached to the base of the clip can match if desired as shown in FIG. 41.

Figure 7:
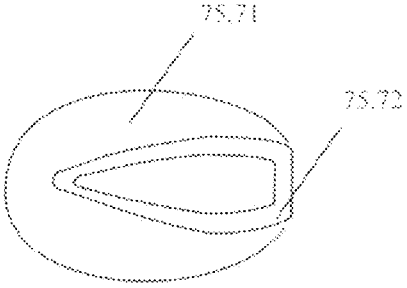
FIG. 7 is a perspective front-side view of the clip used as a component part of the present invention, wherein the base of the clip is shaped to resemble the shaped foam pieces to be attached to the base of the clip to form a cushioning structure or the base of the clip is sufficient enough to the size of the foam shapes to be attached or applied to the base of the clip.
Figure 11:
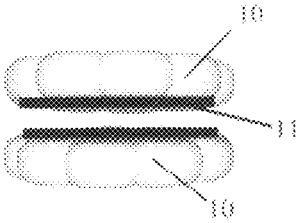
FIG. 11 is a perspective side view of the two foam shapes shown in FIG. 3 and FIG. 4 with adhesive strips or material after adhesive is attached or applied to foam shapes.
Figure 12:
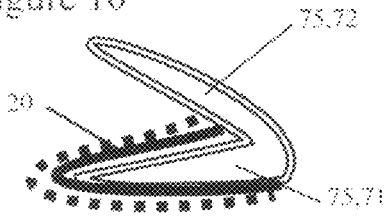
FIG. 12 is a perspective right-side view of the clip as shown FIG. 7 and FIG. 8 with a gelatinous material or plastic coating sandwiching the bottom portion of said clip.
Figure 13:
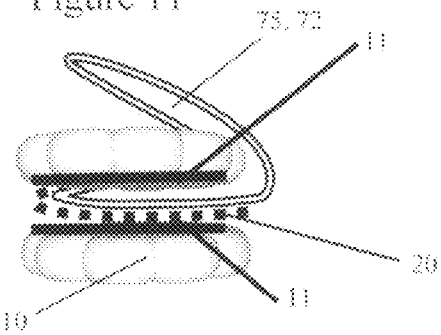
FIG. 13 is a perspective right-side view of the clip as shown in FIG. 7 and FIG. 8 showing the placement of the shaped foam pieces and adhesive prior the sandwiching the clip as shown in FIG. 12.
Figure 14:
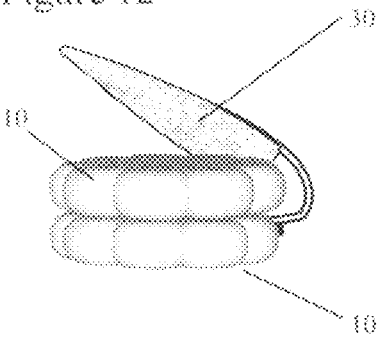
FIG. 14 is a perspective right-side of the view of FIG. 13 after the shaped foam pieces are attached to the clip of FIG. 12 with the gelatinous material or plastic slip-on cover of FIG. 10 is placed over the top-portion of the clip of FIG. 8 or FIG. 12.
Figure 19:
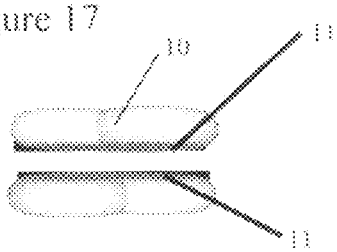
FIG. 19 is a perspective side view of the two foam shapes shown in FIG. 2 with adhesive strips or material after adhesive is attached or applied to foam shapes.

A method of making the present invention is to first select a clip (70,75 or 80) for use. Second, a material layer is selected of gelatinous, soft plastic, flattened foam, fabric, or VELCRO (hook and loop fastener) material selection is made for application onto the base portion of the clip. If the selection of material first covering the base of the clip is gelatinous, soft plastic or flattened foam (scented or unscented) and shaped; an adhesive strip (11) or an adhesive substance (11) is applied to the side of the gelatinous, soft plastic or flattened foam shape on the side that will touch the uncovered base of the clip prior to application, as shown in FIGS. 37 and 38 or the adhesive strip can be applied to the outside of the first material layer covering the base of the clip prong as shown in FIG. 9. Also a shaped adhesive strip is illustrated in FIG. 35. The selection must include two identical pieces of the material selection in this step and adhesive must be applied to both pieces. The adhesive is applied on the side of the selected material that will touch the first material layer sandwiching the clip as shown in FIGS. 9 and 12. After adhesive has been secured to this material selection, then the gelatinous, soft plastic or flattened foam shapes are attached to the front and back side of the base clip prong/s so that both sides being attached are perfectly aligned with each other once the clip is sandwiched between these material layers so that the shape appears to be one piece surrounding the base portion of the clip as shown in FIGS. 22 and 31. This step may be omitted if the gelatinous, soft plastic or flattened foam shape is applied during the manufacturing process to the clip. In this case, only the clip selection is made with the material preference already applied. Regardless of which process is used, the gelatinous, flattened foam or soft plastic shape must still be applied either by a manufacturing process or independently after the material selection is made. If the selection of material to cover the first outer layer surrounding the base portion of the clip is fabric, then the fabric piece is cut to a shape sufficient to cover the clip base and then adhesive is applied using an adhesive strip made for fabric and the adhesive is placed on the side of the fabric that will touch the uncovered clip base prong. A fabric illustration is shown in FIG. 85. This fabric selection must be applied in the same manner to the uncovered base portion of the clip prong/s as the gelatinous, soft plastic or flattened form pieces. Likewise, two identical pieces of fabric are required for this application or a folder-over piece of fabric can be used depending on the shape selected. If a VELCRO (hook and loop fastener) material is selected to cover the uncovered base portion of the clip prong/s, than adhesive is not required. With a VELCRO (hook and loop fastener) material layers, the material need be cut to a preferred shape into two identical pieces and attached to the base of the clip prong/s with the attaching loop and fastener sides facing each other and the smooth side facing outside the base of the clip prong, as shown in FIG. 90. Likewise, the two identical pieces of VELCRO (hoop and loop fastener) must be aligned perfectly about the base of the clip prong/s so that the sandwiched base clip prong/s has the appearance of one shaped piece of the hook and loop fastener surrounding the base of the bottom portion of the clip. The second step can occur during the manufacturing process of the clip or in a separate assembly process after clip selection. Once the gelatinous, fabric, flattened foam, VELCRO (hook and loop fastener), or plastic material has been applied to sandwich the clip prongs on the base of the clip, the clip is ready for other layers or attachments. The third step is the application of shaped foam pieces. Next, a selection of two identical shaped foam pieces (10) is made. The selected foam pieces can be with or without an outer protective coating, depending on the selection. Also, the selection of the shaped foam pieces can be between two types of foam shaped pieces: one type is foam shaped pieces with the adhesive attached already to the foam pieces as shown in FIGS. 11, 19 and 27 or the adhesive can be applied during manufacture: both sides are identical and the adhesive is applied to only one side of the shaped foam piece and the adhesive side is the side that is to be attached to the first layer of material sandwiching or surrounding the base of the clip. The second type is foam shaped pieces without the adhesive attached. If the shaped foam piece selection has adhesive already applied, then the paper must be peeled from the adhesive side of the foam piece, then the shaped foam piece is attached to the gelatinous material at the base of the clip in a centered position just below the clip opening (74) as shown in FIGS. 13, 21 and 29. Both foam shaped pieces are attached: one on the top of base of the clip onto the first material layer sandwiching the clip and one attached to the bottom likewise so that both pieces are perfectly aligned to each other as shown in FIGS. 6, 14, 22, 30 and 41. If the selected shaped foam pieces (10) do not have adhesive, then adhesive must be applied to the gelatinous or plastic material sandwiching the base of the clip first: the adhesive can be applied by using an adhesive strip as shown in FIG. 35 or by straight application of an adhesive substance as shown in FIG. 36. The adhesive strip or the adhesive substance (11) is placed on the shaped form pieces or the gelatinous or plastic material as shown in FIG. 21. To apply a strip, the adhesive strip covering must be removed than placed according to the instructions for applying adhesive strips. Similarly, if an adhesive substance is used, then the adhesive must be applied to the same locations as explained above for placement of an adhesive strip as shown in FIG. 13, 21 or 29. After the adhesive has been applied either to the gelatinous or plastic material as described above, then the shaped foam pieces are attached as described above for applying shaped foam with adhesive applied during manufacture and illustrated in FIG. 6, 14, 22 or 30. Alternatively, a fabric layer may be added to cover the foam piece. To attach a fabric layer, follow the same instructions for applying fabric to the base of the clip prong/s, whereas two pieces of fabric must be cut to fit over the foam pieces and applied with an adhesive strip. This completes the application of a cushioning structure onto the base portion of the clip as shown in FIGS. 7, 23 and 80. Next the top portion (72) of the clip is ready to be covered if not already covered during manufacture. The top portion of the clip may be covered with one of three selections: a fabric cover, a gelatinous or a plastic cover. The gelatinous or plastic covers will be manufactured, so only a selection needs to be made of the color or design that is scented or unscented. The fabric covers will also be manufactured and the process of making a fabric cover has been described in detail in application Ser. No. 11/706,898, the parent application of this application. To attach the slip-on covers, whether fabric, soft plastic, flattened foam or gelatinous materials; just slide the cover onto the top portion of the clip (72) as shown in FIG. 14, 22 or 30, starting with the open end of the slip-on cover. Alternatively, a slip-on cover can be applied that is made of an elongated embroidered, flat foam shape. These elongated shapes will cover the top portion of the clip (72) by adhesive application or these elongated shapes will have a pocket or pouch attached the back side of the elongated shape so that the pocket or pouch will be on the inside of the top portion of the clip. FIG. 100 shows these elongated shapes and their application with a pouch. The pouch or pocket in the present invention will be made of thin plastic, rubber, or fabric. Additionally, if the selection of slip-on covers is not a designer cover as shown in FIG. 32, then a non-designer cover can have decals attached for decorative purposes as shown in FIG. 31. To apply the stick on decals, simply follow the packaging instructions to apply decals. All portions and layers to the present invention are component parts to be manufactured or purchased and assembled. The present invention requires only assembly of these components or layers. The said clip of the present invention is also a component part that will be manufactured as shown with either a clip with prongs extending from the base or bottom portion of the clip or a clip without prongs wherein the base of the clip is shaped to provide sufficient application of the shaped foam. The two different types of clips are shown in FIGS. 7, 8, 15 and 16. The purpose of the clip (70, 75, 80) is to provide a base for the construction of the present invention. The clip cannot be used independently in the present invention to serve the purpose of the present invention.

The present invention having been described with particular reference to the preferred forms thereof; it will be obvious that various changes and modifications may be made without departing from the spirit and scope of the invention as defined herein.

Operation of the Invention

Figure 1:
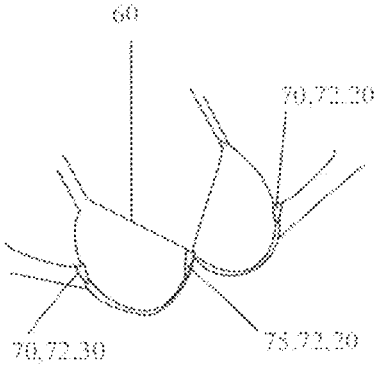
FIG. 1 is a perspective front view of the present invention and its intended use with a bra.
Figure 4:
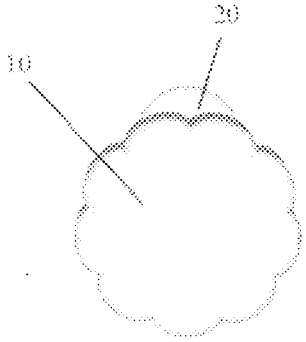
FIG. 4 is a perspective back-side view showing the present invention and its outer back layers as identified in the reference section.
Figure 5:
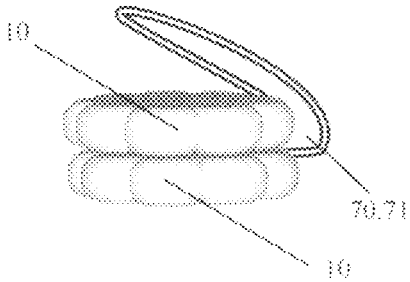
FIG. 5 is a perspective right-side view showing the present invention in the open position with the top portion of the clip uncovered.
Figure 6:
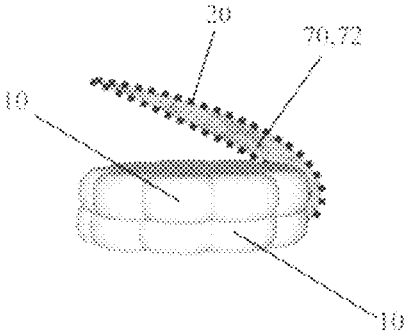
FIG. 6 is a perspective right-side view showing the present invention in the open position with top portion of the clip covered with gelatinous material or plastic.
Figure 8:
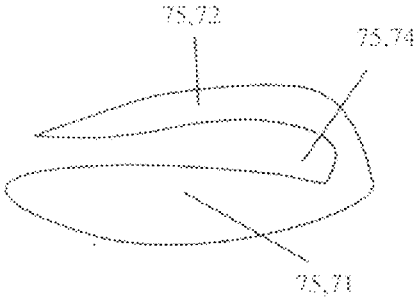
FIG. 8 is a perspective right-side view of the said clip in FIG. 7.

In operation of the present invention, the user must simply open the front clip (72) of the present invention by pushing downward on the front portion of the center of the clip (72). After the clip (70 or 75) is open the user may place the opening (74) of the present invention as shown in FIGS. 8, 16 and 24 over the edge of the bra where the underwire casing or covering is located as shown in FIG. 1 and FIG. 2. The present invention is pushed downward after it is placed over the edge of the bra until the material of the bra is sandwiched between the front portion of the clip (72) and the covered base of the clip (71) as shown in FIG. 1 and FIG. 2. The front portion of the clip should be on the outside of the bra and the back side of the present invention as shown in FIG. 4 should be on the inside of the bra as shown in FIG. 2. After the present invention is in this position, the front portion of the clip (72) is pressed downward again. The present invention is then in a secured position. To remove the present invention the user simply presses downward on the front portion of the clip (72) and it opens the bra saver device, which will allow the user to lift upward on the present invention and remove it from the bra. The clip may be used anywhere on the bra where the underwire casing or covering is present or anywhere else on the bra where rubbing or friction causes discomfort to the user. Some other areas of use may be the back of the bra where the closure is located, in the front of a bra when such bras have front closures, or anywhere along the edges of a bra on the top or bottom edge where friction or rubbing occurs. In many cases the wearer of a bra experiences discomfort in a single area instead of multiple locations on the bra. Multiple attachments of the present invention on a single bra is not recommended but is shown in FIG. 1 and FIG. 2 as possible locations where discomfort usually occurs that may require the use of the present invention; however, all potential locations have not be shown.

Alternative Embodiments

There are various possibilities with regard to the cushioning structure of the present invention that can be utilized to mass produce the bra saver device. Some, but not all, alternative embodiments would be to use other alternative strong materials other than elastic to enclose the base of the clip. These other materials could vary from gelatinous materials, soft plastics, leather or other fabrics to secure the base of the clip prior to covering its outer layer. The cushioning embodiment could also be changed from foam to batting, cotton, or multiple layers of soft durable fabric to enclose the base layer that houses or sandwiches the base of the clip. Also, the outer, visible portion of the cushioning structure and/or the outer covering for the front of the clip could be replaced with many other types of fabric covering that may not be limited to nylon, lingerie fabric or lace, including ribbon.

Furthermore, the manner in which the fabric is attached to the clip base or the front clasp of the clip can be altered to include applying adhesives, VELCRO (hook and loop fastener), snaps or other adhesive materials common on the market for attaching products, including but not limited to, zippers, buttons or fabric closures or a combination thereof. Likewise, the front portion of the clip may be covered or uncovered, decorative or plain. Finally, the shape of the entire cushioning structure that sandwiches the base of the clip can vary.

Many different shapes can be achieved by simply changing the layout of the fabric or foam. The present drawings depict a variety of shapes. The shape could alternatively be changed to resemble a heart, circle, butterfly, fruit or any other shape or size that may be desirable to the consumer. The clip could alternatively be made of a material other than metal. Other clipping mechanisms could be used such as, but not limited to, hard plastics or bendable wire stays that can be secured and covered to function similar to the present invention or bra saver device.

To conclude, there can be many variations to the materials used to mass produce the same result of the present invention which is to provide a cushioning structure that attaches to a bra to stabilize an exposed underwire and provide added protection to the skin from underwires and/or the underwire casing in underwire bras or non-underwire bras that bruise the skin during normal wear. The use of this type of device is novel in that no other inventors have approached the problem of bra discomfort is this manner. The concept of covering the areas that subject wearer to pain or discomfort when wearing both underwire and non-underwire bras is the result of the present invention. Thus, the present invention offers numerous opportunities to construct and design a device that achieves this result that appeals to the consumer's tastes in color, appearance, feel and degrees of comfort and use.

CONCLUSION, RAMIFICATIONS, AND SCOPE

Accordingly, the reader will see that the bra saver device can also be used to protect the bra to which it is attached from being damaged by securing the underwire casing. The present invention also protects the user from sudden or accidental exposure of the underwire from its bra casing. The bra saver device will also provide added protection to the wearer from friction or bruising caused by excessive movement of the bra. In addition, the present invention is easy to attach or remove and is also washable. The present invention is decorative and can be designed in many colors or shapes to appeal to consumer tastes.

What is claimed is:

1. A shaped protective cushioning structure for attachment to any underwire/no underwire brassiere for protecting a wearer of said brassiere from skin abrasion and/or irritation caused by any component of said brassiere, comprising:

a cantilevered, snap close, two sided multi-prog clip encased within a cushioning structure;

said cantilevered snap close multi-pronged clip including two cantilevered sides having a front side and a back side;

said front side including a single-pronged portion;

said back side including a base portion with at least a single-prong shape extending outwardly therefrom;

said front and back side portions snap closed when pressed on one end and snap open when pressed on an opposite end;

said snap close clip being encased by a cushioning structure;

said cushioning structure including a first outer layer selected from the group of any one of fabric, leather, gelatinous material, lace, ribbon, foam, embroidered material, synthetic material, or plastic material surrounding the front portion of the clip;

a second outer layer selected from the group of any one of lace, ribbon, gelatinous material decals, foam, synthetic decals, metallic or jewel type decal's, embroidered or fabric decals disposed about a portion of said fabric, leather, gelatinous material, foam, synthetic or plastic material surface of the first outer layer selection surrounding the front portion of the clip;

a first outer layer selected from the group of any one of gelatinous material, fabric, leather, foam, hook and loop fastener material, synthetic or plastic material covering the inside base portion of the clip;

a second outer layer selected from the group of any one of gelatinous material, fabric, leather, foam, hook and loop fastener material, synthetic or plastic material covering the outside base portion of the clip;

a third outer layer of adhesive disposed about the first exposed outer layer selected from the group of any one of gelatinous material, fabric, leather, foam, hook and loop fastener material, synthetic or plastic material layer of the inside base portion of the clip;

a fourth outer layer of adhesive disposed about the second exposed outer layer selected from the group of any one of gelatinous material, fabric, leather, foam, hook and loop fastener material, synthetic or plastic material layer of the outside base portion of the clip;

a fifth outer layer of shaped foam covering the third outer layer of said adhesive disposed about the first outer layer selected from the group of any one of gelatinous material, fabric, leather, foam, hook and loop fastener material, synthetic or plastic material layer of the inside base portion of the clip;

a sixth outer layer of shaped foam covering the fourth outer layer of said adhesive disposed about the second outer layer selected from the group of any one of gelatinous material, fabric, leather, foam, hook and loop fastener material, synthetic or plastic material layer of the outside base portion of the clip;

a seventh and eighth outer layer selected from the group of any one of fabric, leather, an embroidered decal, plastic decal, or synthetic decal covering the fifth and sixth outer layers of the foam material surrounding the outside and inside base portion of the clip;

wherein said clip and cushioning structure is placeable on a wearer's brassiere in areas of abrasion including at exposed underwires or seam areas of the brassiere structure or on any other component of the brassiere structure that cause abrasion to a wearer's skin surface.

2. A shaped protective cushioning structure for attachment to any underwire/non-underwire brassiere for protecting a wearer as claimed in claim 1, and further wherein said cushioning structure is in the shape of any one of a geometric, animal, insect, floral, food, jewel, moon, star, rectangle, heart, circle, butterfly, fruit, or novelty character shape and is either scented or unscented.

3. A shaped protective cushioning structure for attachment to any underwire/no underwire brassiere for protecting a wearer as claimed in claim 1, and further wherein said clip is constructed from any one of plastic, metal or bendable wire.

4. A shaped protective cushioning structure for attachment to any underwire/no underwire brassiere for protecting a wearer as claimed in claim 1, and further wherein said base portion of clip is any one of a multi-prong or a single-shaped prong.

5. A shaped protective cushioning structure for attachment to any underwire/no underwire brassiere for protecting a wearer as claimed in claim 4, and further wherein said single-shape of the base portion of clip prong is any one of a geometric, animal, insect, floral, food, novelty, jewel, star, rectangle, heart, circle, butterfly or fruit shape extending outwardly therefrom.

6. A shaped protective cushioning structure for attachment to any underwire/no underwire brassiere for protecting a wearer as claimed in claim 4, and further wherein said pronged base portion of the clip includes at least two prongs extending outwardly therefrom.

7. A shaped protective cushioning structure for attachment to any underwire/no underwire brassiere for protecting a wearer as claimed in claim 1, wherein said first outer layer selection of the front portion of the clip is any one or more of lace, ribbon, fabric material, leather material, gelatinous material, embroidered material, foam material, synthetic material or plastic material, and further wherein said first outer layer selection is any one of two separate identical material layers sandwiching the front and back of the top portion of the clip or is a single piece of the material selection that is removably attached to by sliding on and off the top portion of the clip.

8. A shaped protective cushioning structure for attachment to any underwire/no underwire brassiere for protecting a wearer as claimed in claim 1, and further wherein said first outer layer selection from the group of any one of fabric material, leather material, gelatinous material, embroidered material, foam or plastic material layer selection of the front portion of the clip includes any one of numerous colors, multi-colored and is either scented or unscented.

9. A shaped protective cushioning structure for attachment to any underwire/no underwire brassiere for protecting a wearer as claimed in claim 1, and further wherein said second outer layer selection of the front portion of the clip and the seventh and eight layer selection of the base portion of the clip extending outwardly therefrom includes stick-on or sew-on decals, wherein said second, seventh and eighth layers selections are disposed about the material layers enclosing either the top portion of the clip or the base portion of the clip extending outwardly therefrom, and are disposed about the material layer selection on either one side or both sides of the second, seventh or eighth material layer selections covering either of the said top portion of the clip on the bass portion of the clip.

10. A shaped protective cushioning structure for attachment to any underwire/no underwire brassiere for protecting a wearer as claimed in claim 9, and further wherein said second outer layer selection about the first outer layer selection of the front portion of the clip and said fifth, sixth, seventh, or eighth outer material layer selection of stick-on or sew-on decals placeable about the base portion of the clip extending outwardly therefrom includes any one or more of embroidered decals, fabric material, leather material, lace and/or ribbon material, plastic decals, synthetic decals, metal-stud decals, jewel-stud decals, or foam decals.

11. A shaped protective cushioning structure for attachment to any underwire/no underwire brassiere for protecting a wearer as claimed in claim 10, and further wherein said second, seventh, and eighth outer layer selection of stick-on or sew-on decals of the front portion of the clip or the base portion of the clip extending outwardly therefrom includes any one or more of a design of a geometric, animal, insect, floral, food, zodiac, alphabet, jewel, moon, star, heart, circle, butterfly, metallic or jewel stud, fruit or novelty character shaped material.

12. A shaped protective cushioning structure for attachment to any underwire/no underwire brassiere for protecting a wearer as claimed in claim 1, wherein said third outer material layer selection covers the first outer material layer selection of any one of adhesive, gelatinous, plastic, embroidered, foam, hook and loop fastener material, leather material, fabric material layer covering the base portion of the prong base;

and wherein said fourth outer material layer selection covers the second outer material layer selection of any one of adhesive, gelatinous, plastic, foam, hook and loop fastener material, embroidered material, fabric or leather material layer covering the base portion of the prong base;

and wherein said first outer material layer and said third outer material layers cover the prong base and said second and fourth outer material layer selection of any one of adhesive, gelatinous, plastic, foam, hook and loop fastener material, embroidered material, leather or fabric material layers are on the outside of the prong base;

wherein said selection of the first, second, third and fourth material layers sandwich the base portion of the prong base; and the fifth and sixth outer material layer selection is a combination of the material layer selection that includes the adhesive already attached thereto the material layer selection.

13. A shaped protective cushioning structure for attachment to any underwire/no underwire brassiere for protecting a wearer as claimed in claim 1, wherein said fifth and sixth outer material layer selection of any one of gelatinous, plastic, foam, hook and loop fastener material, fabric or leather material layers covering the base portion of the prong base are made in the shape of any one of a geometric, animal, insect, floral, jewel; food, star, rectangle, heart, circle, butterfly, fruit or novelty shaped material.

14. A shaped protective cushioning structure for attachment to any underwire/no underwire brassiere for protecting a wearer as claimed in claim 1, wherein said fifth and sixth material layer selection covering the third and fourth outer material layer selection from the group including any one of adhesive, gelatinous, embroidered, plastic, foam, hook and loop fastener material, leather or fabric material covering and the base portion of the prong base is foam;

wherein said fifth material layer selection covers the third material layer selection that covers the base portion of the prong base;

wherein said sixth material layer selection covers the fourth material layer selection covering the base portion of the prong base;

and wherein said first, second, third and fourth, and fifth and sixth material layers sandwich the base portion of the prong base.

15. A shaped protective cushioning structure for attachment to any underwire/no underwire brassiere for protecting a wearer as claimed in claim 1, wherein said seventh and eighth material layers cover the first, second, third and fourth, and fifth and sixth material layer selections and sandwich the base portion of the prong base are selected from a group of an one or more of fabric material, lace and/or ribbon material, leather material, synthetic material, and a decal, wherein the said outer seventh and eighth layer material selection include either one of enclosing the cushioning structure on all sides by any one of adhesion or sewing, or wherein a decal is the selection and the decal is either disposed about one or both sides of the fifth or sixth outer layer selection of the base portion of the clip extending outwardly therefrom, and further, and wherein said first, second, third and fourth, fifth, sixth, seventh and eighth layer selections sandwich the base portion of the prong base or the decal selection is disposed about the fifth and sixth outer layers that sandwich the clip base.

16. A shaped protective cushioning structure for attachment to any underwire/no underwire brassiere for protecting a wearer as claimed in claim 14, wherein said fifth and sixth material layer selections covering the third and fourth material layer selection covering the base portion of the prone base are identically shaped in any one of a geometric, animal, insect, floral, food, jewel, star, rectangle, heart, circle, butterfly, fruit or novelty shape.

17. A shaped protective cushioning structure for attachment to any underwire/no underwire brassiere for protecting a wearer as claimed in claim 1, wherein said fifth and sixth outer material layer selections includes numerous colors, multi-colors or designs and is scented or unscented and further wherein said layer selection is detachable.

18. A shaped proactive cushioning structure for attachment to any underwire/no underwire brassiere for protecting a wearer as claimed in claim 1, wherein said outer embroidered, leather, fabric, gelatinous, foam, synthetic or plastic material layer selection for the front portion of the clip is any one of single layers of plastic, foam, fabric, leather or gelatinous material attachments by adhesion on the top and bottom side of the front portion of the clip; is a one-piece detachable slip-on cover that is either fabric, leather, gelatinous material, foam, synthetic or plastic material, or an elongated embroidered or foam material.

19. A shaped protective cushioning structure for attachment to any underwire/no underwire brassiere for protecting a wearer as claimed in claim 18, wherein said second outer material layer selection of any one of lace, gelatinous material, plastic, foam of a detachable slip-on cover selection is disposed about the front portion of the detachable slip-on cover of the clip and includes any one of or a combination of geometric, animal, insect, floral, leaf, food, novelty, zodiac, alphabet, jewel, moon, star, rectangle, heart, circle, butterfly or fruit designed shaped decals.

20. A shaped protective cushioning structure for attachment to any underwire/no underwire brassiere for protecting a wearer as claimed in claim 18, wherein said detachable slip-on material cover layer selections for the top portion of the clip includes material of numerous colors, multi-colors or designs and is either scented or unscented.

21. A shaped protective cushioning structure for attachment to any underwire/no underwire brassiere for protecting a wearer as claimed in claim 18, wherein said detachable slip-on material cover shape form is any one of an elongated embroidered or foam floral shape, insect shape, animal shape, novelty shape, fruit shape, a butterfly shape, a lettered shape, food shape, geometric, or heart shape;

wherein said shape includes a pocket or pouch attached to the back side of the shape to allow said elongated shaped cover to slide on and off the top portion of the clip or said elongated shape is double sided and, wherein the double-sided and elongated shape forms a pocket that allows the shape to slide on and off the front portion of the clip.

22. A shaped protective cushioning structure for attachment to any underwire/no underwire brassiere for protecting a wearer as claimed in claim 21, wherein said detachable slip-on material cover shape selection;

includes a pocket or pouch attached to the cover's back side of the shape to allow said elongated shape to slide on and off the top portion of the clip; and further wherein said pocket or pouch is made of any one of a stick-on fabric or stick-on plastic or rubber pouch shaped the size and length of the front portion of the said clip for secure attachment and wherein the inside of the pouch is either slip or non-slip resistant.

23. A method of protecting a wearer of an underwire/no underwire brassiere from abrasion from protruding brassiere components including underwire applications or seams comprising the steps of:

providing a clip-on cushioning structure including a cantilevered, snap close, two sided multi-prong clip encased within a cushioning structure;

said cantilevered snap close pronged clip including two cantilevered sides having a front side and a back side;

said front side including at least single pronged portion;

said back side including a base portion with at least a single prong or a shaped base prong extending outwardly therefrom;

said front and back side portions are curved along their length so that when said front and back sides snap close when pressed on one end and snap open when pressed on the opposite end;

said snap close multi-pronged clip being encased by a cushioning structure;

said cushioning structure including a first outer layer selection of any one of fabric, leather, embroidered material, adhesively applied gelatinous material, synthetic material, plastic or foam material covering the front portion of the clip;

a second outer layer selection of any one or more of lace material, ribbon, gelatinous material, foam, embroidered material or selective decals disposed about at least a portion of said material about the front of the clip;

a first outer layer selection of any one of gelatinous material, foam, hook and loop fastener material, plastic, synthetic, fabric or leather material covering the inside base portion of the clip;

a second outer layer selection of any one of gelatinous material, foam, hook and loop fastener material, plastic, synthetic, fabric or leather material covering the outside base portion of the clip;

a third outer layer of adhesive covering about the first outer layer selection of any one of fabric, leather, synthetic material, embroidered material, adhesively applied gelatinous material, synthetic, plastic or foam material layer inside the base portion of the clip;

a fourth outer layer of adhesive covering about the second layer selection of any one of fabric, leather, synthetic material, embroidered material, adhesively applied gelatinous material, plastic or foam material layer outside the base portion of the clip;

a. fifth outer layer of shaped foam covering a third outer layer of adhesive covering about the first outer layer selection of any one of gelatinous material, foam, hook and loop fastener material, plastic material, synthetic material, embroidered material, fabric or leather material layer inside the base portion of the clip; a sixth outer layer of shaped foam covering a fourth outer layer of adhesive covering about the second outer layer selection of any one of gelatinous material, foam, hook and loop fastener material, plastic material, synthetic material, embroidered material, fabric or leather material layer outside the base portion of the clip;

wherein the first and second material layer selections covering the front portion of said clip are detachable or non-detachable from the clip; and further wherein the seventh and eighth outer material layer selection of any one of fabric, lace and/or ribbon, embroidered material, synthetic material, or leather material, covering the fifth and sixth outer layers of the foam material sandwich the outside and inside base portion of the clip and;

placing said clip and said cushioning structure on a wearer's brassiere or brassiere inclusive garment in areas of the brassiere garment that can abrade the wearer, including areas of exposed under wires, seam areas or on any other abrasive portion of a brassiere or brassiere inclusive garment; and attaching said cushioning structure to a wearer's brassiere or brassiere inclusive garment over said abrading area in between the brassiere abrading area and said skin surface of said wearer in order to protect and provide comfort to said wearer's skin surface from said abrading brassiere area.

24. A shaped protective cushioning structure for attachment to any underwire/no underwire brassiere for protecting a wearer of said brassiere from skin abrasion and/or irritation caused by any component of said brassiere, comprising:

a cantilevered, snap close, two sided multi-prong clip encased within a cushioning structure;

said cantilevered snap close multi-pronged clip including two cantilevered sides having a front side and a back side;

said front side including a single-pronged portion;

said back side including a base portion with at least a single-prong shape extending outwardly therefrom;

said front and back side portions snap closed when pressed on one end and snap open when pressed on an opposite end;

said snap close clip being encased by a cushioning structure;

said cushioning structure including a first outer layer selected from the group of any one of fabric, leather, gelatinous material, lace, ribbon, foam, embroidered material, synthetic material, or plastic material surrounding the front portion of the clip;

a first outer layer selected from the group of any one of gelatinous material, fabric, leather, foam, hook and loop fastener material, synthetic or plastic material covering the inside base portion of the clip;

a second outer layer selected from the group of any one of gelatinous material, fabric, leather, foam, hook and loop fastener material, synthetic or plastic material covering the outside base portion of the clip;

wherein said clip and cushioning structure is placeable on a wearer's brassiere in areas of abrasion including at exposed underwires or seam areas of the brassiere structure or on any other component of the brassiere structure that cause abrasion to a wearer's skin surface.

25. A shaped protective cushioning structure for attachment to any underwire/non-underwire brassiere for protecting a wearer as claimed in claim 24, and further wherein said cushioning structure is in the shape of any one of a geometric, animal, insect, floral, food, jewel, moon, star, rectangle, heart, circle, butterfly, fruit, or novelty character shape and is either scented or unscented.

26. A shaped protective cushioning structure for attachment to any underwire/no underwire brassiere for protecting a wearer as claimed in claim 24, and further wherein said clip is constructed from any one of plastic, metal or bendable wire.

27. A shaped protective cushioning structure for attachment to any underwire/no underwire brassiere for protecting a wearer as claimed in claim 24, and further wherein said base portion of clip is any one of a multi-prong or a single-shaped prong.

28. A shaped protective cushioning structure for attachment to any underwire/no underwire brassiere for protecting a wearer as claimed in claim 27 and further wherein said single-shape of the base portion of clip prong is any one of a geometric, animal, insect, floral, food, novelty, jewel, star, rectangle, heart, circle, butterfly or fruit shape extending outwardly therefrom.

29. A shaped protective cushioning structure for attachment to any underwire/no underwire brassiere for protecting a wearer as claimed in claim 27, and further wherein said multi-pronged base portion of the clip includes at least two prongs extending outwardly therefrom.

30. A shaped protective cushioning structure for attachment to any underwire/no underwire brassiere for protecting a wearer as claimed in claim 24, wherein said first outer layer selection of the front portion of the clip is any one or more of lace, ribbon, fabric material, leather material, gelatinous material, embroidered material, foam material, synthetic material or plastic material, and further wherein said first outer layer selection is any one of two separate identical material layers sandwiching the front and back of the top portion of the clip or is a single piece of the material selection that is removably attached to by sliding on and off the top portion of the clip.

31. A shaped protective cushioning structure for attachment to any underwire/no underwire brassiere for protecting a wearer as claimed in claim 24, and further wherein said first outer layer selection from the group of any one of fabric material, leather material, gelatinous material, embroidered material, foam or plastic material layer selection of the front portion of the clip includes any one of numerous colors, multi-colored and is either scented or unscented.

32. A shaped protective cushioning structure for attachment to any underwire/no underwire brassiere for protecting a wearer as claimed in claim 24, wherein said outer embroidered, leather, fabric, gelatinous, foam, synthetic or plastic material layer selection for the front portion of the clip is any one of single layers of plastic, foam, fabric, leather or gelatinous material attachments by adhesion on the top and bottom side of the front portion of the clip;

is a one-piece detachable slip-on cover that is either fabric, leather, gelatinous material, foam, synthetic or plastic material, or an elongated embroidered or foam material.

33. A shaped protective cushioning structure for attachment to any underwire/no underwire brassiere for protecting a wearer as claimed in claim 32, wherein said detachable slip-on material cover layer selections for the top portion of the clip includes material of numerous colors, multi-colors or designs and is either scented or unscented.

34. A shaped protective cushioning structure for attachment to any underwire/no underwire brassiere for protecting a wearer as claimed in claim 31, wherein said detachable slip-on material cover shape form is any one of an elongated embroidered or foam floral shape, insect shape, animal shape, novelty shape, fruit shape, a butterfly shape, a lettered shape, food shape, geometric, or heart shape and wherein said shape includes a pocket or pouch attached to the back side of the shape to allow said elongated shaped cover to slide on and off the top portion of the clip or said elongated shape is double sided, wherein the double-sided and elongated shape forms a pocket that allows the shape to slide on and off the front portion of the clip.

35. A shaped protective cushioning structure for attachment to any underwire/no underwire brassiere for protecting a wearer as claimed in claim 34, wherein said detachable slip-on material cover shape selection; and further includes a pocket or pouch attached to the cover's back side of the shape to allow said elongated shape to slide on and off the top portion of the clip; and further wherein said pocket or pouch is made of any one of a slick-on fabric or stick-on plastic or rubber pouch shaped the size and length of the front portion of the said clip for secure attachment.

36. A method of protecting a wearer of an underwire/no underwire brassiere from abrasion from protruding brassiere components including underwire applications or seams comprising the steps of:

providing a clip-on cushioning structure including a cantilevered, snap close, two sided multi-prong clip encased within a cushioning structure;

said cantilevered snap close pronged clip including two cantilevered sides having a front side and a back side;

said front side including at least single pronged portion;

said back side including a base portion with at least a single prong or a shaped base prong extending outwardly therefrom;

said front and back side portions are curved along their length so that when said front and back sides snap close when pressed on one end and snap open when pressed on the opposite end;

said snap close multi-pronged or single shaped prong clip being encased by a cushioning structure;

said cushioning structure including a first outer layer selection of any one of fabric, leather, embroidered material, gelatinous material, synthetic material, plastic or foam material covering the front portion of the clip;

a first outer material layer selection of any one of gelatinous material, foam, hook and loop fastener material, plastic, synthetic, fabric or leather material covering the inside base portion of the clip;

a second outer material layer selection of any one of gelatinous material, foam, hook and loop fastener material, plastic, synthetic, fabric or leather material covering the outside base portion of the clip;

wherein the first material layer selection covering the front portion of said clip is detachable or non-detachable from the clip and;

placing said clip and said cushioning structure on a wearer's brassiere or brassiere inclusive garment in areas of the brassiere garment that can abrade the wearer, including areas of exposed under wires, seam areas or on any other abrasive portion of a brassiere or brassiere inclusive garment; and attaching said cushioning structure to a wearer's brassiere or brassiere inclusive garment over said abrading area in between the brassiere abrading area and said skin surface of said wearer in order to protect and provide comfort to said wearer's skin surface from said abrading brassiere area.

* * * * *